United States Patent [19]

Penny

[11] 4,079,779

[45] Mar. 21, 1978

[54] ROTARY REGENERATIVE HEAT EXCHANGER

[75] Inventor: Robert Noel Penny, Solihull, England

[73] Assignee: Caterpillar Tractor Co., Peoria, Ill.

[21] Appl. No.: 599,686

[22] Filed: Jul. 28, 1975

[51] Int. Cl.[2] ..... F28D 19/00

[52] U.S. Cl. ..... 165/7; 60/39.51 H

[58] Field of Search ..... 165/7, 10, 174; 60/39.51 H

[56] References Cited

U.S. PATENT DOCUMENTS

| | | | |
|---|---|---|---|
| 3,092,477 | 6/1963 | Persson | 165/7 X |
| 3,196,611 | 7/1965 | Henny | 60/39.51 H |
| 3,902,550 | 9/1975 | Martin | 165/104 F |

*Primary Examiner*—Albert W. Davis, Jr.

*Attorney, Agent, or Firm*—Gifford, Chandler, Sheridan & Sprinkle

[57] ABSTRACT

A rotary regenerative heat exchanger including a supply duct for admitting fluid to an area of a face of the matrix of the heat exchanger bounded by a seal, the supply duct having an outlet covered by a ported distribution plate in which ports are so arranged that the fluid is admitted to the matrix face area bounded by the seal in a predetermined distribution pattern. For example, the ports may be arranged to effect either uniform fluid flow or uniform fluid pressure throughout the matrix face area bounded by the seal.

3 Claims, 2 Drawing Figures

ROTARY REGENERATIVE HEAT EXCHANGER

BACKGROUND OF THE INVENTION

I. Field of the Invention

The invention relates to a rotary regenerative heat exchanger.

II. The Prior Art

In such a heat exchanger, the heat storing matrix is usually a disc or drum and the fluids between which heat exchange is to be effected are introduced to the matrix through a duct communicating with a seal bounding an area of an end or peripheral face of the matrix. As the area of the matrix face embraced by the seal is usually substantial, there is a tendency for the fluid introduced by the duct to be unevenly distributed over the area embraced by the seal. This is particularly pronounced in a disc-shaped matrix in which a seal defines an area of sector or segment shape in an end face of the matrix. An object of the invention is to provide means for introducing the fluid to the area of the matrix bounded by the seal in such a manner that the distribution follows a predetermined pattern over the area of the matrix bounded by the seal.

SUMMARY OF THE INVENTION

According to the invention, a rotary regenerative heat exchanger comprising a matrix, a seal defining an inlet area in a face of the matrix for the introduction thereto of one of the fluids between which heat exchange is to be effected and means for effecting relative rotation between the matrix and the seal, also includes a supply duct through which said fluid is admitted to the area of the matrix bounded by the seal, the supply duct having an outlet covered by a ported distribution plate in which ports are so arranged that the fluid is admitted to the area of the matrix bounded by the seal in a predetermined distribution pattern over the area of the matrix bounded by the seal.

For example, the ports in the distribution plate may be so arranged that the fluid distribution is such that the fluid flow is substantially uniform throughout the area of the matrix bounded by the seal.

Alternatively, the ports in the distribution plate may be so arranged that the fluid distribution over the area of the matrix bounded by the seal is such that the pressure of fluid applied to the matrix is substantially uniform throughout the area of the matrix bounded by the seal.

The ports may be discrete apertures of substantially uniform size and spaced apart throughout the area of the distribution plate, the spacing and number of the apertures in different parts of the distribution plate determined by the required distribution pattern.

Alternatively the apertures may be of different sizes in different parts of the distribution plate, the apertures of larger area being provided at the positions where a greater volume of the fluid is to be introduced to the matrix.

DESCRIPTION OF THE DRAWINGS

By way of example, an application of the invention to a rotary regenerative heat exchanger having two disc-shaped matrices is now described with reference to the accompanying drawings, in which.

Figure 2:
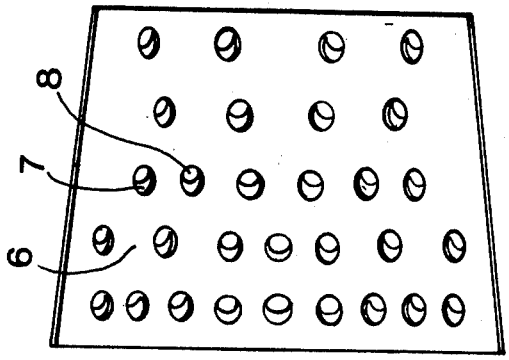
FIG. 2 is a view of a fluid distribution plate, shown in FIG. 1, looking in the direction of arrow II therein.
Figure 1:
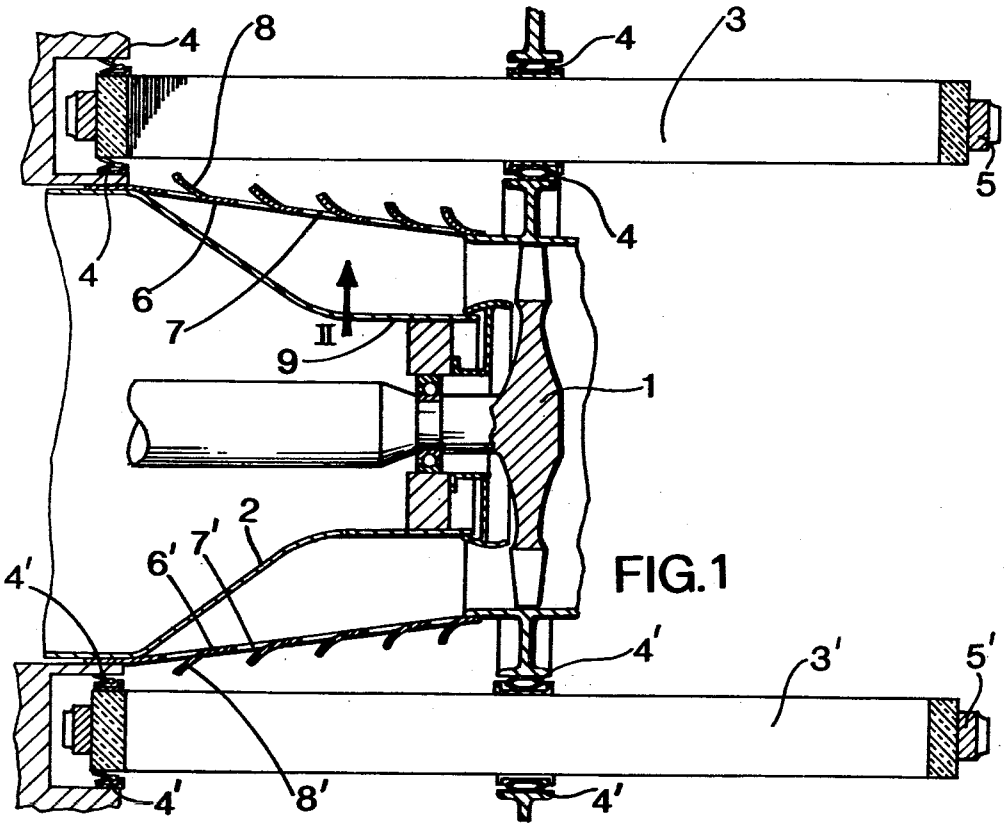
FIG. 1 shows a turbine rotor and the two heat exchanger matrices in axial cross section.

Referring to the drawings, the turbine rotor 1 is arranged to discharge hot exhaust gases through an annular duct 2 to part of the adjacent end faces of a pair of disc-shaped matrices 3, 3' arranged one at each side of the turbine axis. The area in the end face of each matrix 3, 3' through which exhaust gases are to be passed are defined by seals indicated at 4, 4'. The seals 4, 4' define a sector-shaped area in the adjacent end face of the respective matrix 3, 3' and this may be substantially semi-circular or of sector-shape having an included angle of less or greater than 180°. Compressed air to be heated by the turbine exhaust gases is passed in counter-flow through the remainder of or another part of each matrix. The flow area for air through the matrices may be defined by other seals (not shown). The seals 4, 4' and any additional seals are supported by a housing in which the matrices are mounted. Each matrix is arranged to be rotated by means of an annular driving gear 5, 5', engaged by a driving pinion (not shown).

The hot exhaust gases are discharged from the duct 2 into the area bounded by the sector-shaped seals 4, 4' at the adjacent end face of each matrix through a sector-shaped distribution plate 6, 6'. Each plate 6, 6' has a plurality of discrete apertures 7, 7', each of the same area, spaced apart both radially and circumferentially thereof. The number, spacing of the apertures 7, 7' are such that the rate of flow of exhaust gases throughout the area circumscribed by the seal is substantially uniform. Alternatively the arrangement of the apertures is such that the flow follows a predetermined pattern over the area circumscribed by the seal. Desirably the arrangement of apertures 7, 7' is such that the pressure of gas is substantially uniform despite the differing distances of the apertures from the outlet from the turbine. Where the rate of flow throughout the area of the matrix bounded by the seal is to be substantially uniform, there would be more apertures nearer to the radially-outer periphery of each of the plates 6, 6' than to the radially-inner periphery thereof.

Instead of providing discrete apertures of uniform area, the areas may be selected to give the required distribution pattern. For example, arcuate distribution slots may be provided at different radii in each plate 6, 6', the length or total length of the arcuate slot or slots at each radial position being greater nearer to the outer periphery of the plate 6, 6' than the inner periphery thereof.

As illustrated, the flow from the apertures 7, 7' may be aided by deflector surfaces 8, 8' extending from each plate 6, 6' toward the adjacent end face of the associated matrix 3, 3'. The deflector surfaces 8, 8' may be formed by punching portions of the plate 6, 6' of almost complete circular or other shape from the side of the plate 6, 6' which will be remote from the associated matrix 3, 3' to form a flap on the other side of the plate 6, 6' to provide the deflector surface and also to form the apertures 7, 7'.

The plates 6, 6' may be flat or curved. For example they may each be part of a duct for leading fluid to the matrices, such as a frusto-conical sleeve co-axially surrounding the turbine shaft, between an inner wall 9 defining the duct 2 and the matrices 3, 3'.

What I claim as my invention and desire to secure by Letters Patent of the United States is:

1. A rotary regenerative heat exchanger comprising a matrix, a seal defining an inlet area in a face of the matrix for the introduction thereto of one of the fluids between which heat exchange is to be effected, means effecting relative rotation between the matrix and said seal, a supply duct having an outlet through which said fluid is admitted to the said matrix face inlet area, and a ported distribution plate positioned in said supply duct outlet and extending over said matrix face inlet area at a position spaced therefrom in the direction of fluid flow therethrough, said distribution plate having spaced ports therein to admit fluid to said matrix face inlet area in a predetermined distribution pattern and a plurality of deflector surfaces, one associated with each said port, extending from the outlet side of said distribution plate.

2. A rotary regenerative heat exchanger comrpising a disc-like matrix through which hot exhaust gas and compressed air to be heated thereby are to be passed, a seal defining an inlet area in an end face of the matrix for the introduction thereto of said hot exhaust gas, means effecting relative rotation between said matrix and said seal, a supply duct having an outlet through which said hot exhaust gas is admitted to said matrix face inlet area, and a ported distribution plate positioned in said supply duct outlet and extending over said matrix face inlet area at a position spaced from said end face of the matrix in the axial direction thereof, said distribution plate having spaced ports therein to admit fluid to said matrix face inlet area in a predetermined distribution pattern and a plurality of deflector surfaces, one associated with each said port, extending from the outlet side of said distribution plate.

3. A rotary regenerative heat exchanger comprising a matrix, a seal defining an inlet area in a face of the matrix for the introduction thereto of one of the fluids between which heat exchange is to be effected, means effecting relative rotation between the matrix and said seal, a supply duct having an outlet through which said fluid is admitted to the said matrix face inlet area, and a ported distribution plate positioned in said supply duct outlet, said distribution plate having discrete apertures therein of substantially uniform size and spaced apart in the distribution plate, the spacing and number of the apertures in different parts of said distribution plate determining a required distribution pattern, and a plurality of deflector surfaces, one associated with each said aperture, extending from the outlet side of said distribution plate.

* * * * *